US005363618A

United States Patent [19]

Underwood

[11] Patent Number: 5,363,618

[45] Date of Patent: Nov. 15, 1994

[54] CONSTRUCTION SITE SAFETY

[76] Inventor: Daniel C. Underwood, 12 Lewisham Ct., Birkdale, Queensland, 4159, Australia

[21] Appl. No.: 923,985

[22] PCT Filed: Mar. 22, 1991

[86] PCT No.: PCT/AU91/00110

§ 371 Date: Sep. 22, 1992

§ 102(e) Date: Sep. 22, 1992

[87] PCT Pub. No.: WO91/14839

PCT Pub. Date: Oct. 3, 1991

[30] Foreign Application Priority Data

| | | | |
|---|---|---|---|
| Mar. 22, 1990 | [AU] | Australia | PJ 9247 |
| Apr. 30, 1990 | [AU] | Australia | PJ 9885 |
| Sep. 10, 1990 | [AU] | Australia | PK 2215 |
| Dec. 6, 1990 | [AU] | Australia | PK 3739 |

[51] Int. Cl.[5] ..... B65D 59/06

[52] U.S. Cl. ..... 52/301; 52/687

[58] Field of Search ..... 52/301, 726.1, 727, 52/728, 127.1, 127.2, 682, 685–689, 677, 665, 669, 741.3, 745.19, DIG. 12

[56] References Cited

U.S. PATENT DOCUMENTS

| | | | |
|---|---|---|---|
| 3,104,681 | 9/1963 | Gay | 138/96 R |
| 3,160,175 | 12/1964 | Laemmle | 138/96 R |
| 3,197,171 | 7/1965 | Michalak | 52/686 |
| 3,289,378 | 12/1966 | Carroll | 52/688 |
| 3,319,328 | 5/1967 | Finger et al. | 52/301 |
| 3,338,018 | 8/1967 | Mess | 52/687 |
| 3,488,907 | 1/1970 | Aberg | 52/689 |
| 3,623,289 | 11/1971 | Lowery | 52/677 X |
| 3,693,311 | 9/1972 | Bjerking | 52/677 |
| 4,202,378 | 5/1980 | Bush | 138/96 R |
| 4,463,538 | 8/1984 | Dragunas | 52/687 X |
| 4,575,985 | 3/1986 | Eckenrodt | 52/677 |
| 4,694,863 | 9/1987 | Klopp | 138/96 R |
| 4,833,850 | 5/1989 | Cunn | 52/301 |

*Primary Examiner*—Carl D. Friedman
*Assistant Examiner*—Beth A. Aubrey
*Attorney, Agent, or Firm*—Young & Thompson

[57] ABSTRACT

A reinforcement bar end cap (15) comprising a hollow body which can be placed over the free end of an exposed reinforcing bar (12), the body having an impact member receiving slot or aperture (17) so that an impact member (16 ) can be adjustably located in the receiving slot or aperture adjacent the free end of the bar, in order for the impact member to take the brunt of impact from a falling person, so as to prevent impalement of a person on the bar.

4 Claims, 8 Drawing Sheets

CONSTRUCTION SITE SAFETY

TECHNICAL FIELD OF THE INVENTION

This invention relates to construction site safety and in particular to a method and apparatus for reducing the risk of impalement of a person falling on exposed reinforcing steel.

BACKGROUND ART

Reinforced concrete structures are usually made in a number of stages including construction of the form work, tying the steel and pouring the concrete. In order to maintain a structural link between say, foundations and walls or floors, it is usual to "tie" reinforcing bars between the structures so that the bars are common to both structures. This invariably results in the bars being exposed for a period of time which presents an occupational hazard to workers who may fall on the bars and suffers serious injury including impalement.

OUTLINE OF THE INVENTION

An object of the present invention is to reduce the risk of impalement by providing in one aspect, a method for reducing the risk of impalement of a person falling on exposed reinforcing steel, the method including capping the free ends of exposed reinforcing bars with at least one impact member, the or each impact member being adjustably locatable relative to the respective free ends of the respective bars so that the or each impact member takes the brunt of impact from the falling person to prevent impalement of the person on the bar.

In another aspect, the invention resides in a partially completed concrete construction including a plurality of exposed reinforcing bars, each bar having a free end, an end cap removably located over each free end and an impact member extending in adjustable relationship from each end cap so as to take the brunt of impact of a falling person and thereby prevent impalement of a person on any of the bars.

In still a further aspect, the invention resides in a reinforcement bar end cap when used or sold or offered for sale or hired or offered for hire, for the purpose of reducing the risk of impalement of a person falling on exposed reinforcing steel, the end cap comprising a hollow body which can be placed over the free end of an exposed reinforcing bar, the body having an impact member receiving means so that an impact member can be adjustably located in the receiving means adjacent the free end of the bar, in order for the impact member to take the brunt of impact from a falling person, so as to prevent impalement of a person on the bar.

The end cap can be of any desired shape and is preferably arranged so that the free end of the reinforcing bar is aligned with or in contact with the impact member so that when a person falls upon the impact member, the impact member engages with the bar so that the responsive force cf the bar is delivered directly or indirectly to the impact member. Advantageously, the hollow body includes a self-centering means in order to center the bar relative to the impact member. The self-centering means is preferably a tapered internal neck adapted to "wedge fit" over the free end of the reinforcing bar. Advantageously, the tapered internal neck is tapered sufficiently so that an end cap can cater for a number of different diameter bars. Alternatively, the end cap can include centering flanges, shoulders or stops or any other suitable means for locating the free end of the reinforcing bar in a predetermined attitude relative to the impact member.

The end cap preferably includes an upper surface free of any projecting portions which, in use, is likely to increase the risk of puncture of the eye of a person falling on the end cap. Advantageously, the upper surface is generally convex presenting an upwardly curved or domed surface.

The impact member receiving means can be a through hole or a slot of any suitable cross-sectional which allows for adjustable movement of the impact member relative to the cap. Advantageously, the hole or slot is preferably a transverse hole or slot relative to the longitudinal axis of the reinforcing bar so that the impact member and the end cap form a generally T-shaped structure in cross-section. Where a slot is employed, it is preferable that the slot is so sized as to allow insertion of the impact member into the slot using a hand insertable clip action which causes resilient movement of the slot to clip the impact member in place. The slot can be located anywhere on the cap but is preferably located in an upper surface. The impact bar receiving means can be keyed to the shape of the impact member so that, in use, the reinforcing bar is automatically located in a predetermined position relative to the impact member.

The impact member can be of any shape or configuration so as to distribute impact over a larger area than would be the case for the single end cap or for the exposed reinforcing bar. Preferably however, the impact member comprises a removable rigid rod or bar along which the cap can slide to a predetermined position. In this way, a plurality of caps can be located on a single impact bar in order to cap a plurality of spaced exposed reinforcing bars.

The partially completed concrete construction can represent any stage of construction where injuries may occur. For example, the construction can be at the stage of form work prior to pouring, where reinforcing is tied thereby exposing the free ends of reinforcing bars in a situation where a person could be injured.

BRIEF DESCRIPTION OF THE DRAWINGS

In order that the invention can be more readily understood and be put into practical effect, reference will now be made to the accompanying drawings and wherein.

METHOD OF PERFORMANCE

Figure 1:
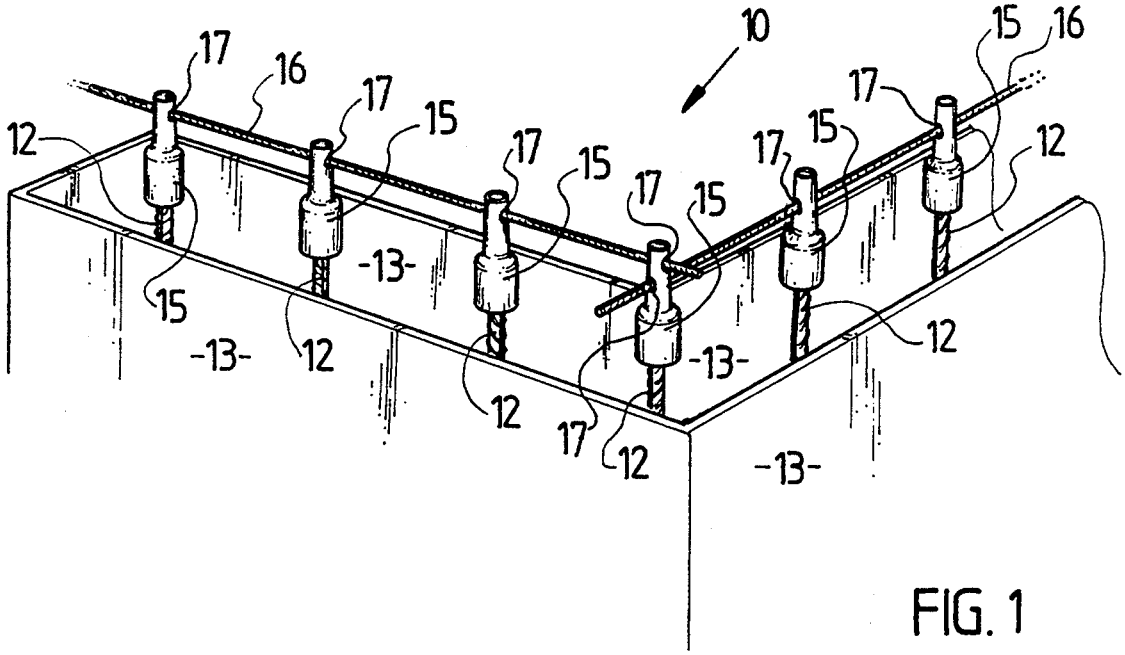
FIGS. 1 and 2 are perspective views illustrating concrete constructions employing the method of the present invention.
Figure 2:
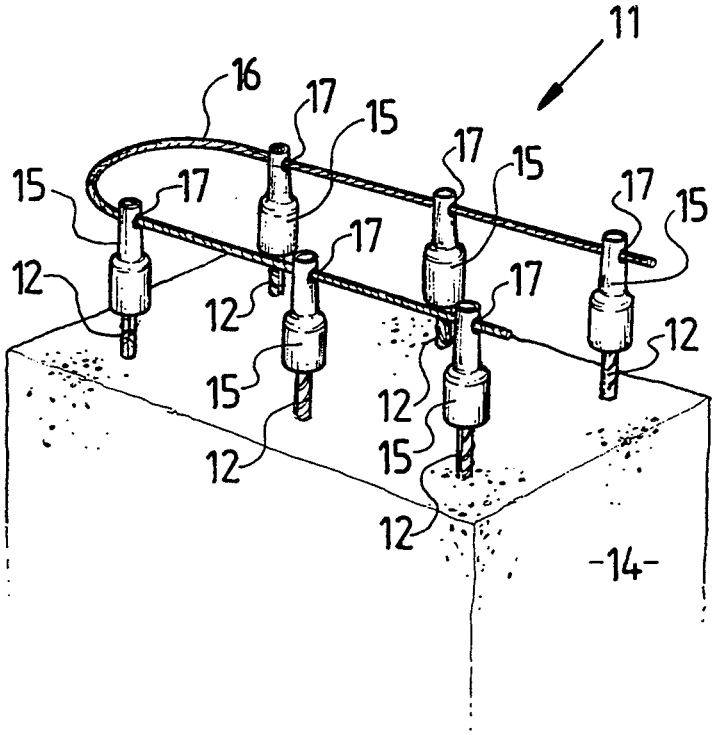

Referring to the drawings and initially to FIGS. 1 and 2 which illustrate concrete constructions 10 and 11 respectively. The construction 10 of FIG. 1 is prior to pouring concrete about reinforcement bars 12 and includes form work in the form of plywood boxing 13 whereas in FIG. 2, the construction 11 represents a concrete construction after the concrete has been poured and the form work has been removed to reveal a block 14 of concrete With protruding bars 12.

It will be appreciated that Without the present invention the bars 12 would normally be exposed and should a person fall upon the exposed bars 12, the person would be impaled upon the bars 12.

As the method of the present invention has been employed in each of FIGS. 1 and 2, each of the exposed reinforcing bars has been capped using removable reinforcement end caps 15 which in the illustrated embodiment are bridged by impact members in the form of horizontal reinforcing bars 16 which pass through holes 17 in the end caps 15. The free ends of the bars 16 can be turned over or otherwise bent to improve safety.

The end caps 15 are free to slide along the bars 16 through the holes 17 so that they can be located at any appropriate spacing suitable to accommodate the spacing between the upstanding reinforcement bars 12. Thus, the system has complete adjustability to suit varying conditions.

Figure 3:
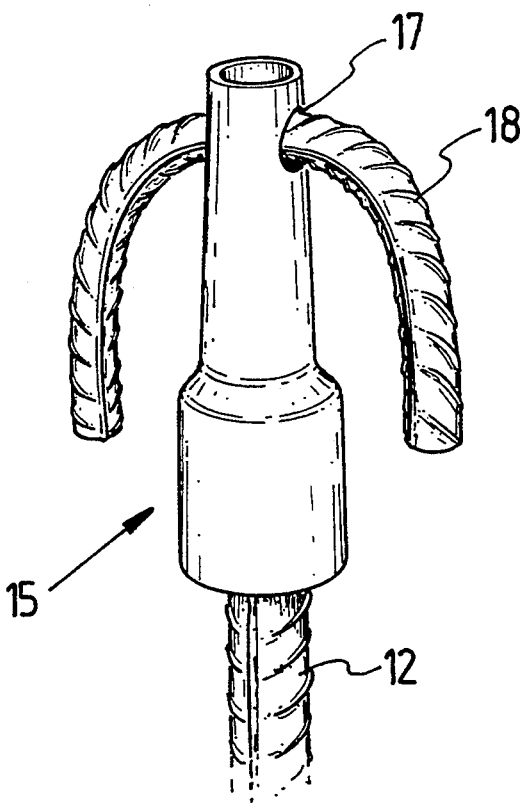
FIGS. 3 and 4 are typical examples of the application of the present invention to single reinforcing bars.
Figure 4:
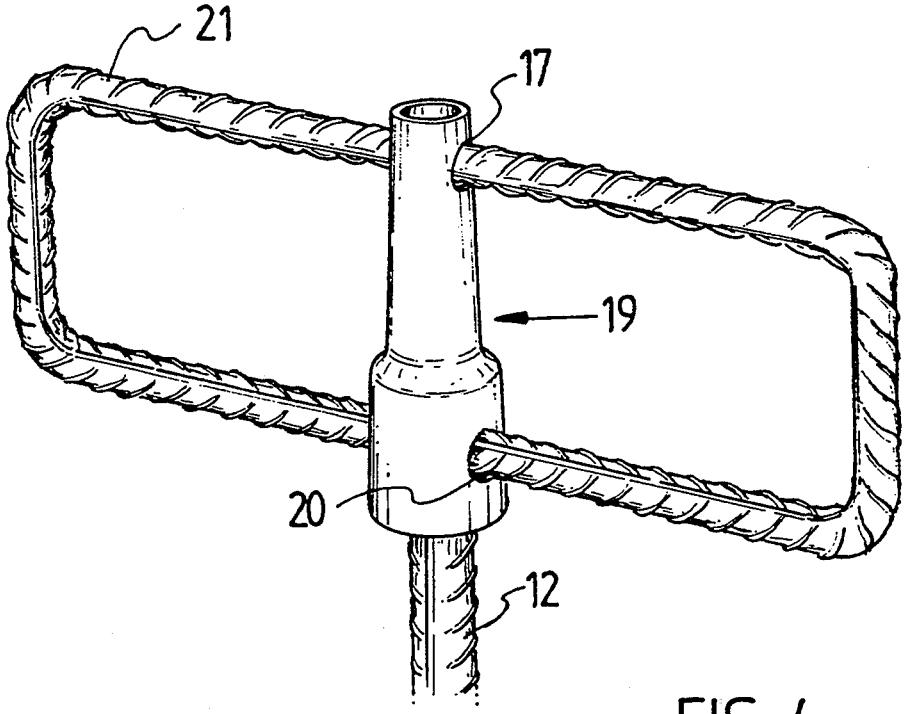

FIGS. 1 and 2 illustrate application of the present invention to a plurality of spaced reinforcement bars whereas FIGS. 3 and 4 illustrate typical arrangements suitable for single reinforcement bars 12. Like numerals have been used to illustrate like features. The end cap illustrated in FIG. 3 is the same end cap as illustrated in FIGS. 1 and 2. However, the impact member in this case is a curved length of bar 18 which can be completely removed from the end cap 15 through the hole 17.

In the case of FIG. 4, the end cap 19 includes an additional through hole 20 and the impact member is in the form of a rectangular link 21 and due to the resilience in the link 21 and the resilience in the end cap 19, which in this case is made from plastics material, the free ends of the link 21 can be "clipped" in and out of the through hole 20 in order for the end cap 19 to be removed from the link 21. The long side of the link 21 in this embodiment is approximately 30 cm in order to distribute the impact of a falling person over a relatively large area.

Figure 5:
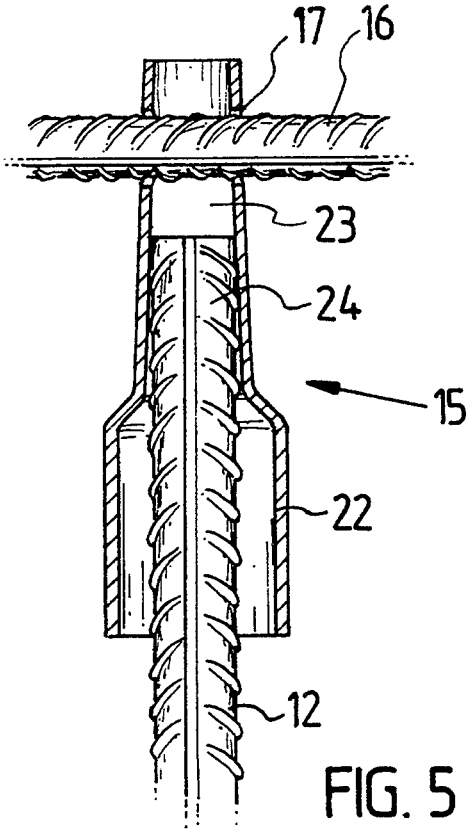
FIG. 5 is a cross-sectional view through a reinforcement bar end cap of the type illustrated in FIGS. 1 and 2 showing the relationship between the reinforcement bar and an impact member.

Referring to FIG. 5, there is illustrated the relationship between an upstanding reinforcement bar 12 and a typical impact member 16 for an end cap 15 of the type illustrated in FIGS. 1 and 2. As can be seen, the end cap includes a base 22 and a tapered internal neck 23 so that the free end 24 of the bar 12 wedges against the internal neck 23 of the cap 15. This serves as a self-centering feature so that the free end of the bar 12 is aligned with the bar 16. In this way, the force of a person falling upon the impact member 16 will be delivered directly on to the free end of the bar 12. This therefore, prevents the free end of the bar 12 from accidentally sliding beyond the impact bar 16 and impaling the falling person. As can be seen, the taper on the internal neck of the cap 15 can range over the length of the neck from between 2 mm to 5 mm depending on the degree of taper and accordingly, a cap can be conveniently suited to a range of bar diameters over approximately a 5 mm range.

It is therefore envisaged, that three cap sizes be applicable to general application of the present invention to the standard range of reinforcement bars that are available. For example, a cap having base diameter of 16 mm inside diameter and tapering to an inside diameter of 5 mm would be suitable for 6 mm, 10 mm and 12 mm outside diameter bars, while a cap having a 24 mm inside diameter tapering to a 12 mm inside diameter would be suitable for 16 mm and 20 mm outside diameter bars. For larger bar sizes having outside diameters ranging from 24 mm to 36 mm, a cap having an inside diameter of 39 mm and tapering to an inside diameter of 23 mm would be suitable.

Figure 6:
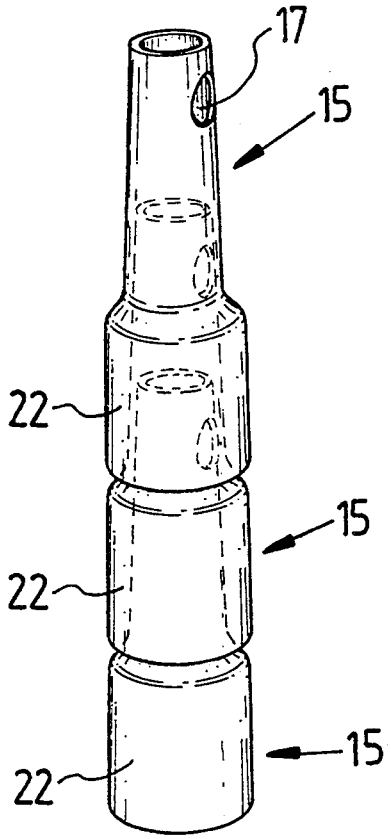
FIG. 6 is a perspective view illustrating how the end caps of FIGS. 1 and 2 can be stacked.

The caps are suitably designed so that they are stackable for easy transport and as can be seen in FIG. 6, it is preferable that caps be designed to stack fairly securely together and due to the tapered internal neck, this is possible. It is advantageous that the exterior the cap tapers to a certain degree as well so that the caps themselves can wedge into a stacked arrangement as illustrated in FIG. 6 so that they can be carried around a construction site as a fairly secure length of caps.

Figure 7:
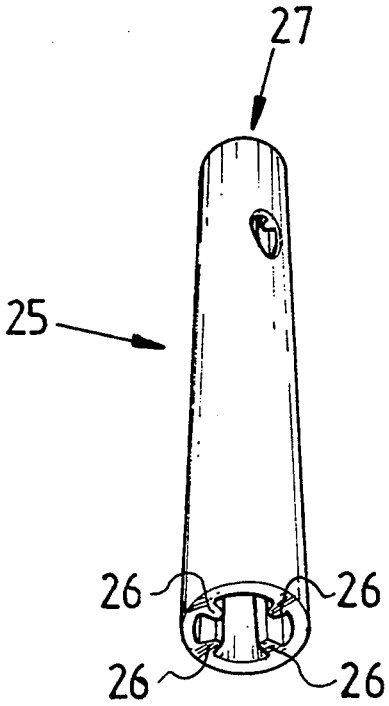
FIG. 7 is a perspective view illustrating an alternative end cap suitable for use in the method of the present invention.
Figure 8:
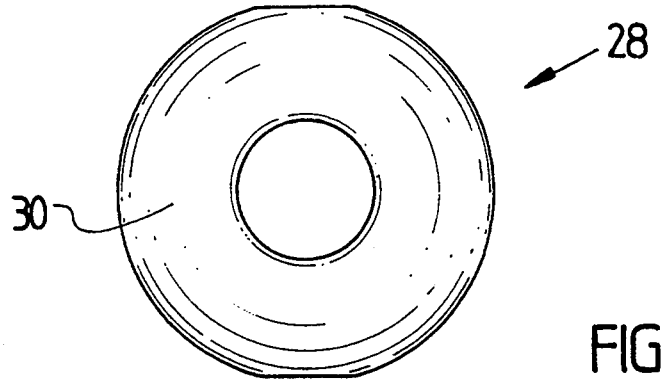
FIGS. 8, 9 and 10 are respective plan, side and inverted plan views illustrating a preferred end cap according to the present invention.
Figure 9:
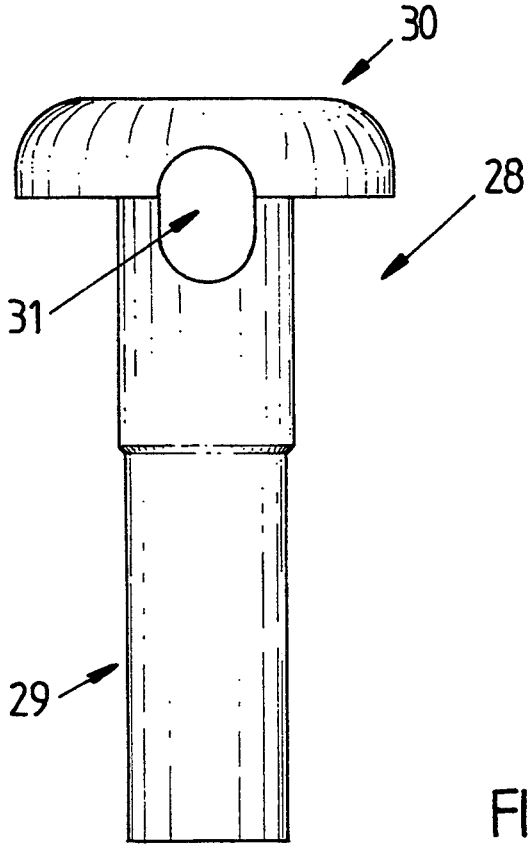
Figure 10:
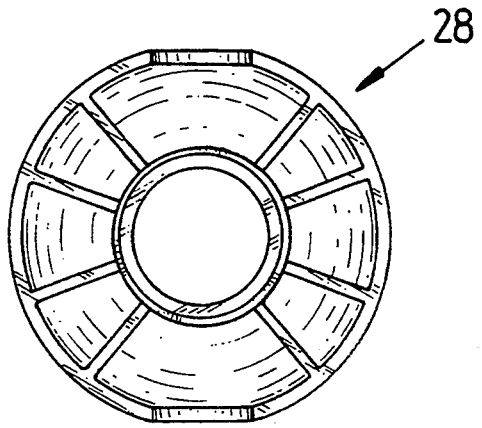
Figure 11:
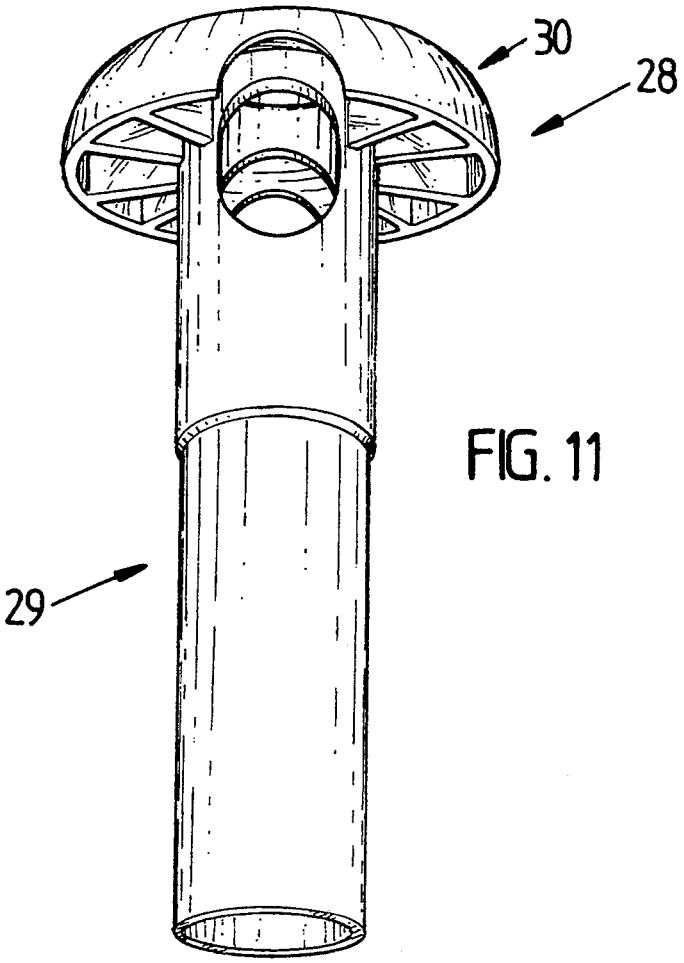
FIG. 11 is a perspective view from below of the end cap FIGS. 8 to 10.
Figure 12:
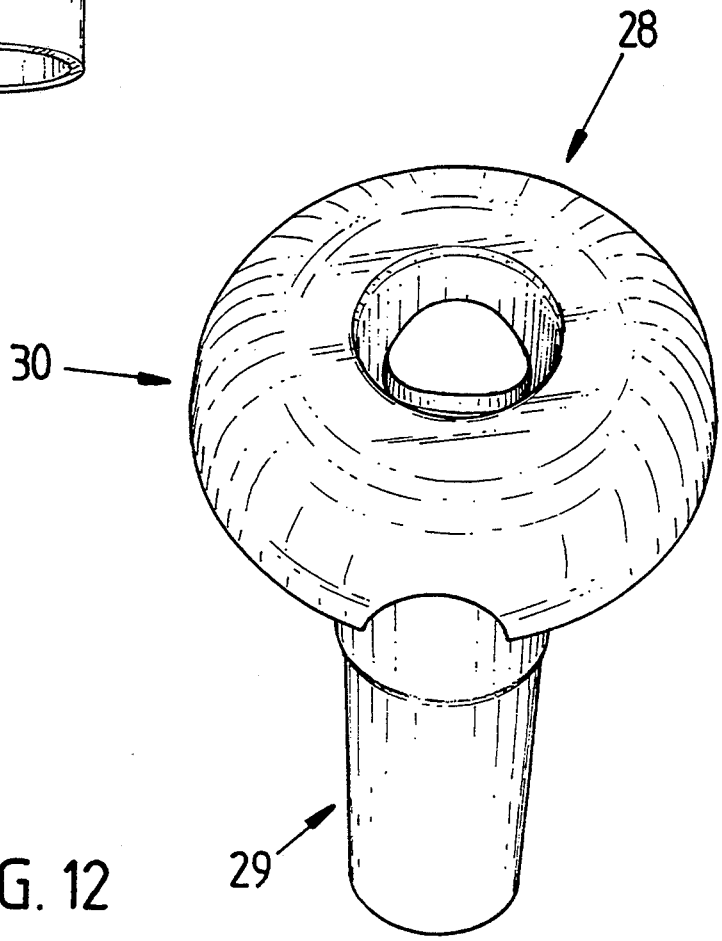
FIG. 12 is a perspective view from above of the end cap illustrated in FIGS. 8 to 11.

While the caps illustrated in FIGS. 1 through 6 have a self-centering tapered internal neck, there are of course other arrangements which can suitably locate the impact member relative to the free end of an exposed reinforcement bar when the cap is located in place. One example is illustrated in FIG. 7 wherein in this embodiment, the end cap 25 includes internal centering flanges 26 which taper toward the end 27 of the cap 25 so that again, the reinforcement bar 12 can wedge in position centrally below the impact member.

Referring to FIGS. 8 to 13, additional embodiments are illustrated, there is illustrated a reinforcement bar end cap 28 having a hollow stem 29 and a dome-like cap 30 over the stem 29 and a transverse through-hole 31, which is elongate in shape, is provided in the stem so that a rocking action can be employed to facilitate movement of the end cap 28 along a bar inserted through the through-hole 31. The shape of the through-hole 31 also serves to key an impact bar of predetermined cross-section into a predetermined orientation with respect to the end cap.

The through-hole 31 has a keying effect as long as it is employed with a square bar which has a width approximately equal to the width of the through-hole. Thus, the impact bar cannot be inadvertently located on its edge.

Figure 13:
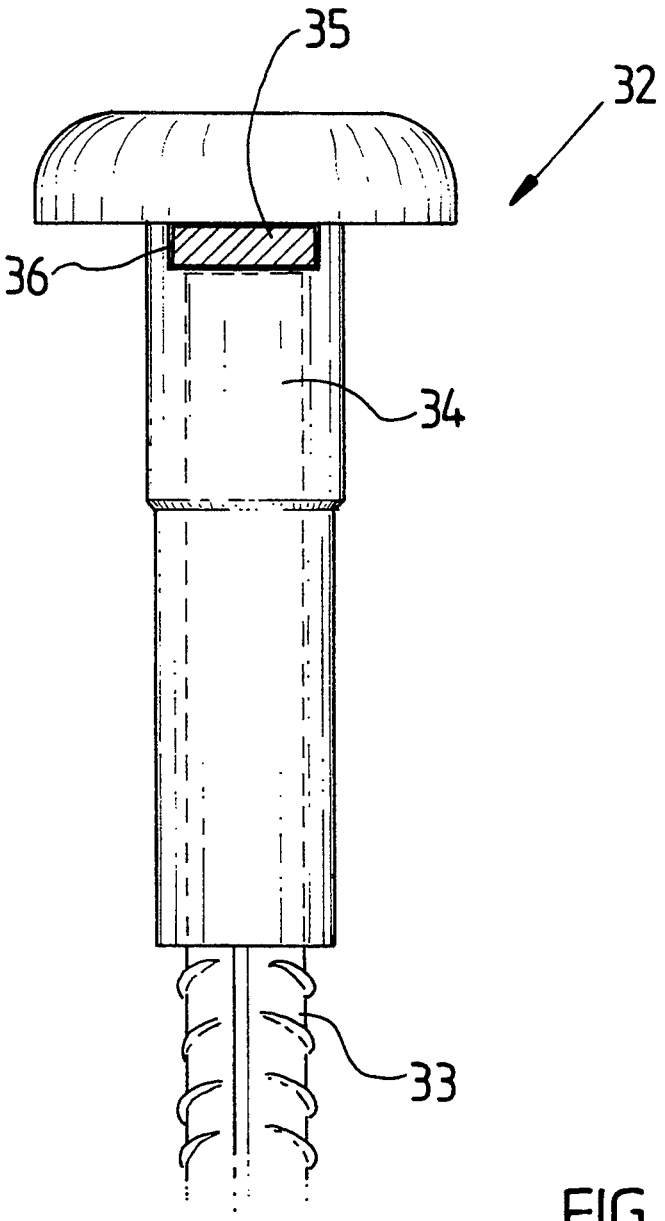
FIG. 13 is a side view illustrating a further embodiment of a cap according to the present invention.

Referring to FIG. 13, there is illustrated a further embodiment where the end cap 32 is shown in place on a reinforcing bar 33, the free end portion 34 of the bar being shown in phantom. An impact bar 35 is shown in position and as can be seen, the through-hole 36 and impact bar 35 are of rectangular cross-section so that the impact bar is "keyed" so that its broadest face is presented to the free end of the bar 33.

Figure 17:
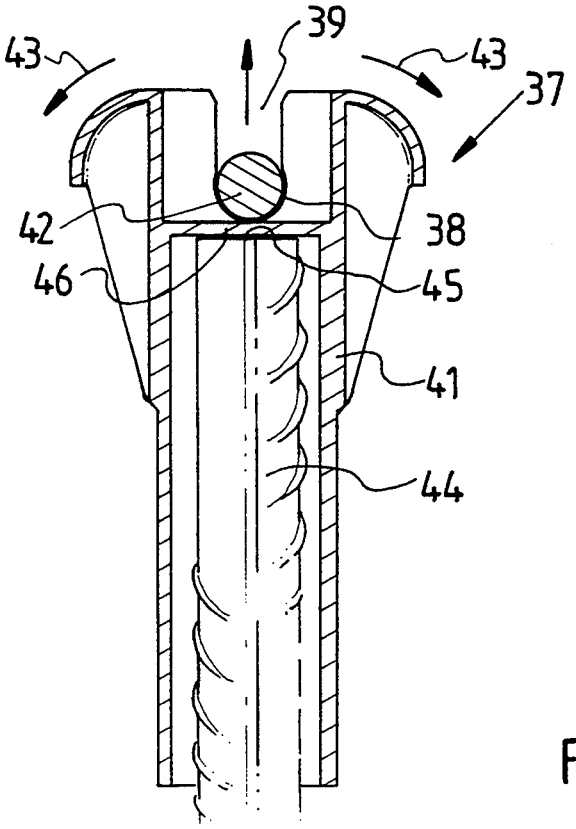

Referring now to FIGS. 14 through 17, there is illustrated a further embodiment of the present invention wherein an end cap 37 has a hole in the form of a transverse slot 38 having a narrow neck 39 in a dome-like cap 40 attached to a stem 41 so that a bar 42 can be forced through the slot 38 using a hand insertable clip action which causes resilient movement of the cap 40 as depicted by the arrows 43 in FIG. 17.

Figure 14:
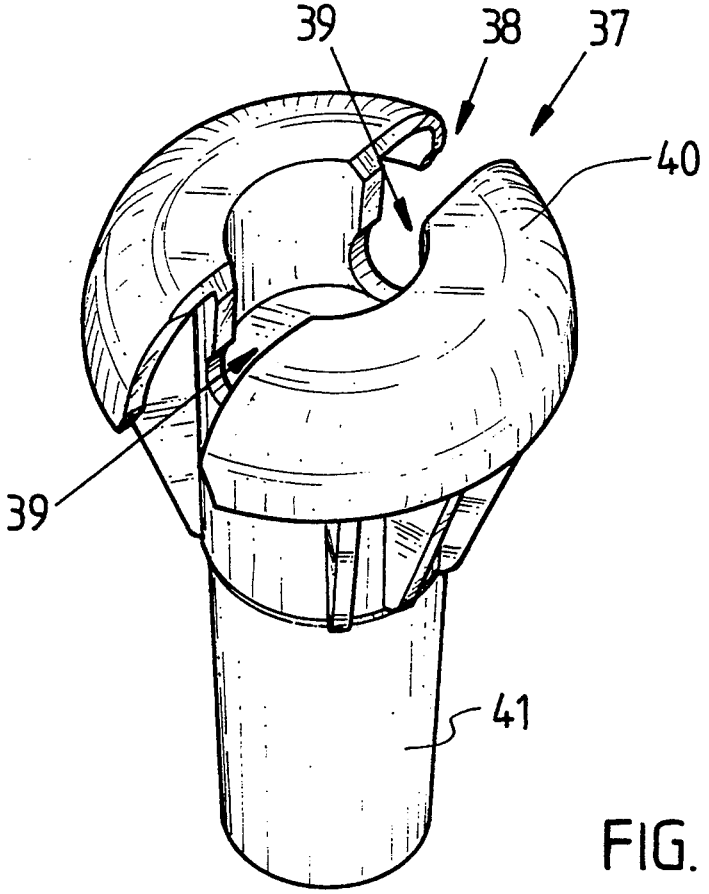
FIGS. 14 and 15 are perspective views from above- and below respectively illustrating a further embodiment of the present invention.
Figure 15:
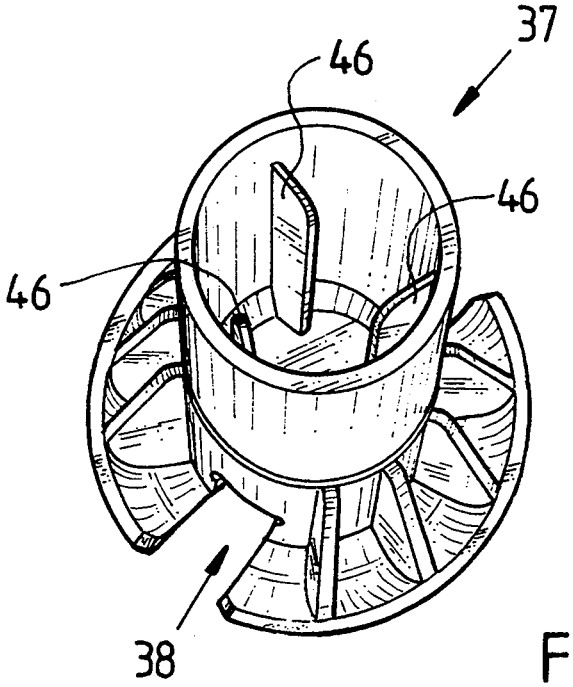
Figure 16:
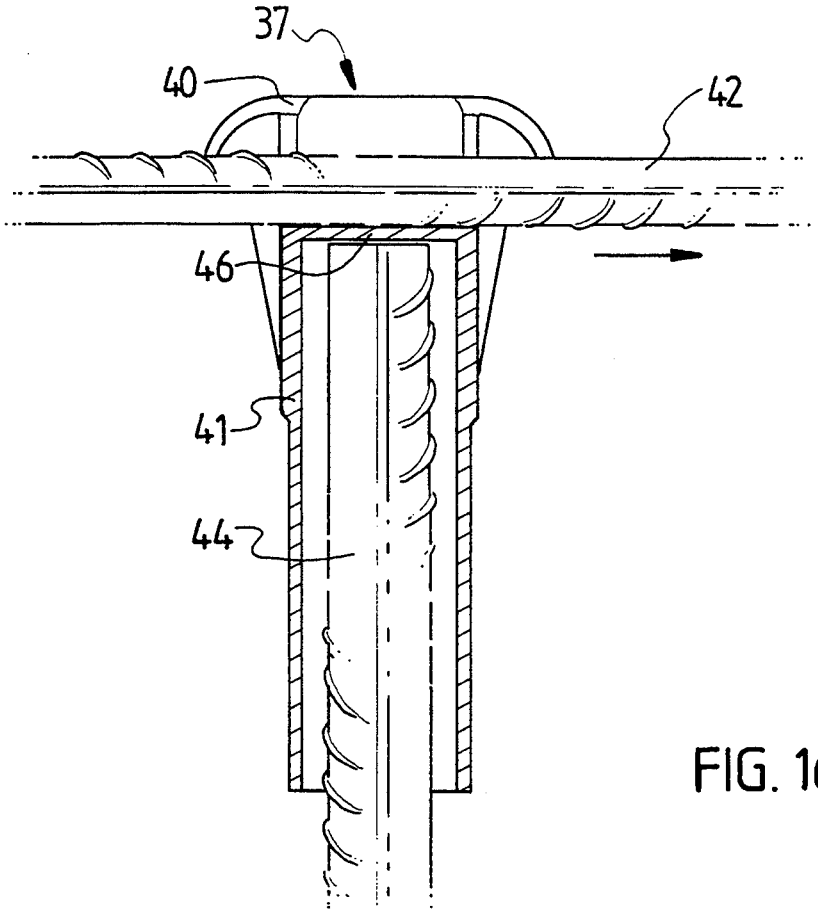
FIGS. 16 and 17 are sectional views illustrating more detail the embodiment of FIGS. 14 and 15.

It will be appreciated that the embodiment illustrated in FIGS. 14 through 17 can be used in all the applications illustrated in relation to the previous embodiments but has the advantage that the cap 37 need not be threaded onto the impact member from a free end thereof. In the embodiment of FIGS. 14 through 17, the free end 45 of the bar 44 and the bar 42 are separated by a bridging piece 45 of material which is under compression during impact if a person falling on the bar 42 or on the cap 37. Under this arrangement, it is unlikely that the cap would be damaged significantly during impact. Likewise, it is unlikely that the bar 44 would pass beyond the bar 42 under the impact of a person falling upon the arrangement as illustrated. In FIG. 14, the bar 42 has been omitted for the purpose of illustrating the interior of the slot 38. In addition to the above features, the embodiment illustrated includes self-centering flanges 46 which are tangentially set so that bars of varying diameter can be accommodated and automatically centered.

Whilst the above has been given by way of illustrative example of the present invention, there will be many other arrangements of caps and impact members and modifications thereto which will be apparent to those skilled in the art without departing from the broad ambit and scope of the invention as set forth in the appended claims.

I claim:

1. A method for reducing the risk of impalement of a person falling on free ends of exposed reinforcing bars, the method including capping the free ends of exposed reinforcing bars with a bar end cap having an impact member receiving means for adjustably locating an impact member in the receiving means relative to the respective free ends of the respective bars whereby the impact member takes the brunt of impact from the falling person to prevent impalement of the person on the bar.

2. The method according to claim 1, wherein the impact member is coupled to a reinforcement bar using a reinforcement bar end cap, the impact member being detachably secured to the end cap by a hand insertable clip action.

3. A partially completed concrete construction including a plurality of exposed reinforcing bars, each bar having a free end, an end cap removably located over each free end and an impact member extending in adjustable relationship from each end cap so as to take the brunt of impact of a falling person and thereby prevent impalement of a person on any of the bars.

4. A partially completed concrete construction according to claim 3, wherein the end cap includes a slot and the impact member is secured in the slot by a hand insertable clip action.

* * * * *